US008851143B2

(12) United States Patent
Zhu

(10) Patent No.: US 8,851,143 B2
(45) Date of Patent: Oct. 7, 2014

(54) SINGLE PULL ROPE DRIVING DEVICE FOR A WINDOW SHADE

(71) Applicant: Xiang-Rong Zhu, Macau (MO)

(72) Inventor: Xiang-Rong Zhu, Macau (MO)

( * ) Notice: Subject to any disclaimer, the term of this patent is extended or adjusted under 35 U.S.C. 154(b) by 7 days.

(21) Appl. No.: 13/845,364

(22) Filed: Mar. 18, 2013

(65) Prior Publication Data

US 2014/0124607 A1 May 8, 2014

(30) Foreign Application Priority Data

Jul. 23, 2012 (CN) ..... 2012 1 0255204

(51) Int. Cl.
*E06B 9/56* (2006.01)
*E06B 9/38* (2006.01)

(52) U.S. Cl.
CPC ..... *E06B 9/38* (2013.01)
USPC ..... 160/121.1; 160/304.1

(58) Field of Classification Search
USPC ..... 160/121.1, 170, 175, 248, 304.1, 308, 160/319, 320, 303
See application file for complete search history.

(56) References Cited

U.S. PATENT DOCUMENTS

| | | | | | |
|---|---|---|---|---|---|
| 44,602 | A * | 10/1864 | Campbell | 160/299 |
| 597,046 | A * | 1/1898 | Wilson | 160/171 |
| 1,325,105 | A * | 12/1919 | Minnis | 160/242 |
| 1,563,267 | A * | 11/1925 | Eckermann | 160/303 |
| 1,568,203 | A * | 1/1926 | Bernard | 160/300 |
| 2,552,956 | A * | 5/1951 | Ganter | 160/175 |
| 4,476,910 | A * | 10/1984 | Saito | 160/291 |
| 4,513,805 | A | 4/1985 | Mase | 160/299 |
| 5,791,393 | A * | 8/1998 | Judkins | 160/321 |
| 6,129,131 | A * | 10/2000 | Colson | 160/84.02 |
| 6,142,211 | A * | 11/2000 | Judkins | 160/308 |
| 7,578,334 | B2 * | 8/2009 | Smith et al. | 160/319 |
| 7,665,507 | B2 * | 2/2010 | Naoki | 160/308 |
| 8,281,846 | B2 | 10/2012 | Zhu | 160/319 |
| 2004/0261958 | A1 | 12/2004 | Sugiyama et al. | 160/296 |
| 2011/0011543 | A1 | 1/2011 | Zhu | 160/312 |

FOREIGN PATENT DOCUMENTS

| | | | |
|---|---|---|---|
| CN | 2251321 | 4/1997 | A47H 5/032 |
| CN | 2329751 | 7/1999 | E06B 9/68 |
| CN | 2725495 | 9/2005 | E06B 8/80 |
| CN | 1693651 | 11/2005 | E06B 9/40 |
| CN | 101025073 | 8/2007 | E06B 9/68 |
| CN | 101139909 | 3/2008 | E06B 9/30 |
| CN | 101139910 | 3/2008 | E06B 9/68 |
| CN | 101263969 | 4/2008 | A47H 1/00 |
| CN | 101263970 | 4/2008 | A47H 3/02 |

(Continued)

*Primary Examiner* — David Purol
(74) *Attorney, Agent, or Firm* — Alan Kamrath; Kamrath IP Lawfirm, P.A.

(57) ABSTRACT

A single pull rope driving device for a window shade includes a rotation driving device (3) mounted to a bracket (1) and having a pull rope (12). A gear (7) is jointly rotatable with a reeling drum (2) for releasing/winding a curtain cloth (26). A rack (9) is movable in a vertical direction and includes teeth (10*a*) releasably engaged with the gear (7). A return spring (11) biases the rack (9) to disengage the teeth (10*a*) of the rack (9) from the gear (7). An actuating member (13) mounted on the pull rope (12) can move the rack (9) downward by pulling the pull rope (12), driving the gear (7) and the reeling drum (2) to rotate in a winding direction. The gear (7) and the reeling drum (2) are rotatable in the winding or releasing direction by pulling the pull rope (12) downward without actuating the rack (9).

9 Claims, 12 Drawing Sheets

(56) References Cited

FOREIGN PATENT DOCUMENTS

| | | | |
|---|---|---|---|
| CN | 101240691 | 8/2008 | E06B 9/68 |
| CN | 201106396 | 8/2008 | E06B 9/30 |
| CN | 201148833 | 11/2008 | E06B 9/68 |
| CN | 201152137 | 11/2008 | E06B 9/68 |
| CN | 101476443 | 7/2009 | E06B 9/68 |
| CN | 101634217 | 1/2010 | E06B 9/80 |
| WO | WO2006133639 | 12/2006 | E06B 9/40 |

* cited by examiner

SINGLE PULL ROPE DRIVING DEVICE FOR A WINDOW SHADE

BACKGROUND OF THE INVENTION

The present invention relates to a curtain device and, more particularly, to a single pull rope driving device for a window shade.

In a conventional window shade having a plurality of slats, it is necessary to flip the slats to completely close or open the gaps between the slats after the window shade is unfolded. Conventional window shades generally include an additional driving device to flip the slats. However, the additional driving device occupies the limited installation space for functional components of the window shades and results in disadvantages such as complicated structure and inconvenient use.

BRIEF SUMMARY OF THE INVENTION

It is an objective of the present invention to provide a single pull rope driving device for a window shade. The single pull rope driving device does not occupy the limited installation space for functional components of the window shade and has advantages of simple structure, easy operation, and releasing/winding operations in opposite directions.

The present invention fulfills the above objective by providing a single pull rope driving device including a bracket. The single pull rope driving device further includes a rotation driving device mounted to the bracket and having a pull rope. A reeling drum is rotatably mounted to the bracket or the rotation driving device. The reeling drum is adapted to release/wind a curtain cloth by pulling the pull rope. A gear is rotatably mounted to the bracket or the rotation driving device. The gear is jointly rotatable with the reeling drum and includes a plurality of teeth. An actuating member is mounted on the pull rope and located below the gear in a vertical direction. A rack is movable in the vertical direction and includes upper and lower ends spaced from each other in the vertical direction. The upper end of the rack includes at least one tooth releasably engaged with the teeth of the gear. The lower end of the rack is located below the gear in the vertical direction and actuatable by the actuating member. A return spring is coupled to the rack and biases the rack to a disengagement position in which the at least one tooth of the rack disengages from the teeth of the gear. The gear and the reeling drum are rotatable in a releasing or winding direction by pulling the pull rope downward without actuating the rack. On the other hand, if the actuating member is actuated by pulling the pull rope to move the rack downward in the vertical direction, the at least one tooth of the rack is moved to engage with the plurality of teeth of the gear and drives the gear and the reeling drum to rotate in the releasing direction.

In an embodiment, the rack further includes an extension extending transversely from the lower end of the rack. A notch is formed in the extension of the rack and has an opening. The pull rope is releasably engaged in the notch via the opening. When the pull rope is engaged in the notch and pulled downward, the actuating member presses against the extension of the rack to move the rack downward in the vertical direction and to drive the gear and the reeling drum to rotate in the releasing direction.

In comparison with the prior art, the single pull rope driving device of the present invention has advantages of simplified structure, easy operation, and releasing/winding operations in opposite directions without occupying the limited installation space for functional components of the window shades.

The present invention will become clearer in light of the following detailed description of illustrative embodiments of this invention described in connection with the drawings.

Figure 1:
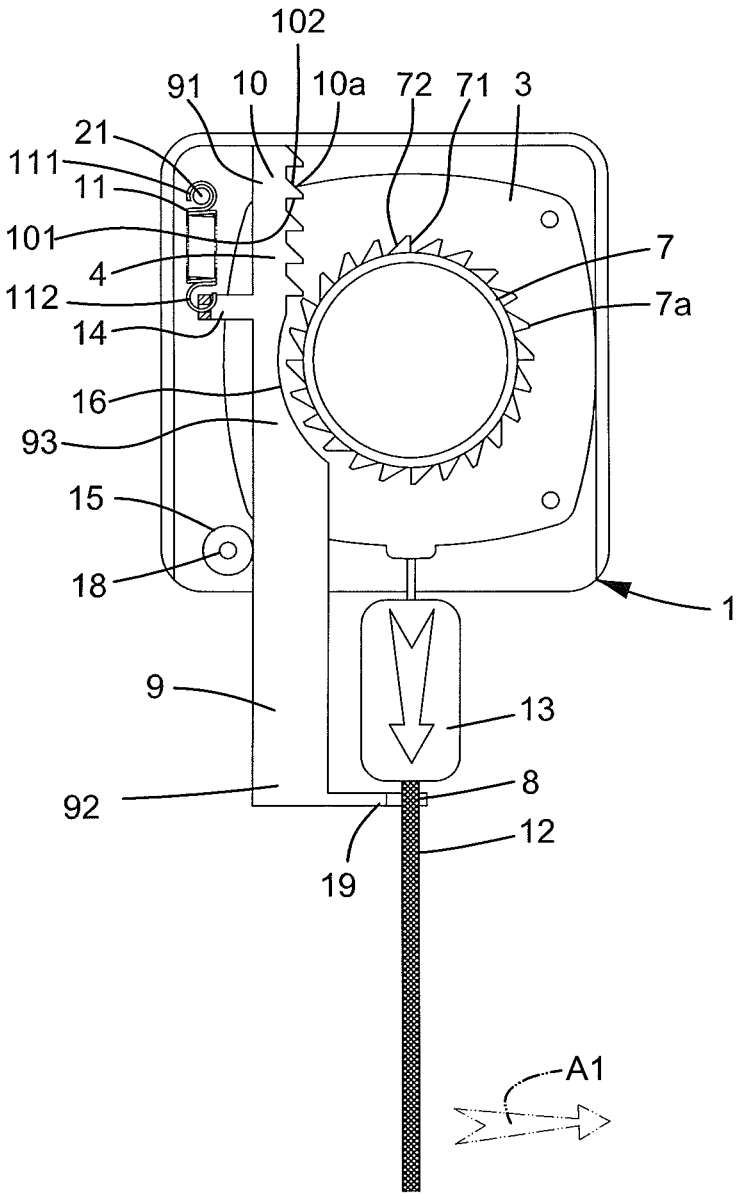
FIG. 1 shows a schematic side view of a single pull rope driving device of a first embodiment of the present invention.

All figures are drawn for ease of explanation of the basic teachings of the present invention only; the extensions of the figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "first", "second", "lower", "upper", "inner", "outer", "end", "horizontal", "vertical", "downward", "counterclockwise", and similar terms are used herein, it should be understood that these terms have reference only to the structure shown in the drawings as it would appear to a person viewing the drawings and are utilized only to facilitate describing the invention.

DETAILED DESCRIPTION OF THE INVENTION

With reference to FIGS. 1, 2*a*, 2*b*, 3-5, a single pull rope driving device for a window shade according to the present invention generally includes a bracket 1. A rotation driving device 3 of single pull rope type is mounted to bracket 1 for driving a reeling drum 2 to rotate in a releasing or winding direction. Reeling drum 2 is mounted to bracket 1 or rotation driving device 3 for releasing/winding a curtain cloth directly connected to reeling drum 2 or indirectly connected to reeling drum 2 by strings. In this embodiment, rotation driving device 3 includes a pull rope rotary disc box 3*a* fixed to bracket 1. A pull rope rotary disc 3*c* is rotatably mounted in pull rope rotary disc box 3*a* and wound with a pull rope 12. A unidirectional clutch device 6 is connected to pull rope rotary disc 3*c*. A rewinding spring 3*e* is mounted in pull rope rotary disc 3*c*.

Unidirectional clutch device 6 includes a chamber 6*d* defined in pull rope rotary disc box 3*a* and coaxial to an axis A of pull rope rotary disc box 3*a*, a driving shaft 6*e* mounted to pull rope rotary disc 3*c* and coaxial to axis A, a transmission shaft 6*f* mounted in chamber 6*d*, and a driving spring 6*g* mounted around driving shaft 6*e* and transmission shaft 6*f* in chamber 6*d* and abutting an inner periphery of chamber 6*d*. Transmission shaft 6*f* in chamber 6*d* has an outer diameter not larger than that of driving shaft 6*e*.

Driving spring 6*g* is in tight contact with driving shaft 6*e* and the inner periphery of chamber 6*d*. Transmission shaft 6*f* is extended out of chamber 6*d* and connected to reeling drum 2 by a connecting shaft 17.

Figure 5:
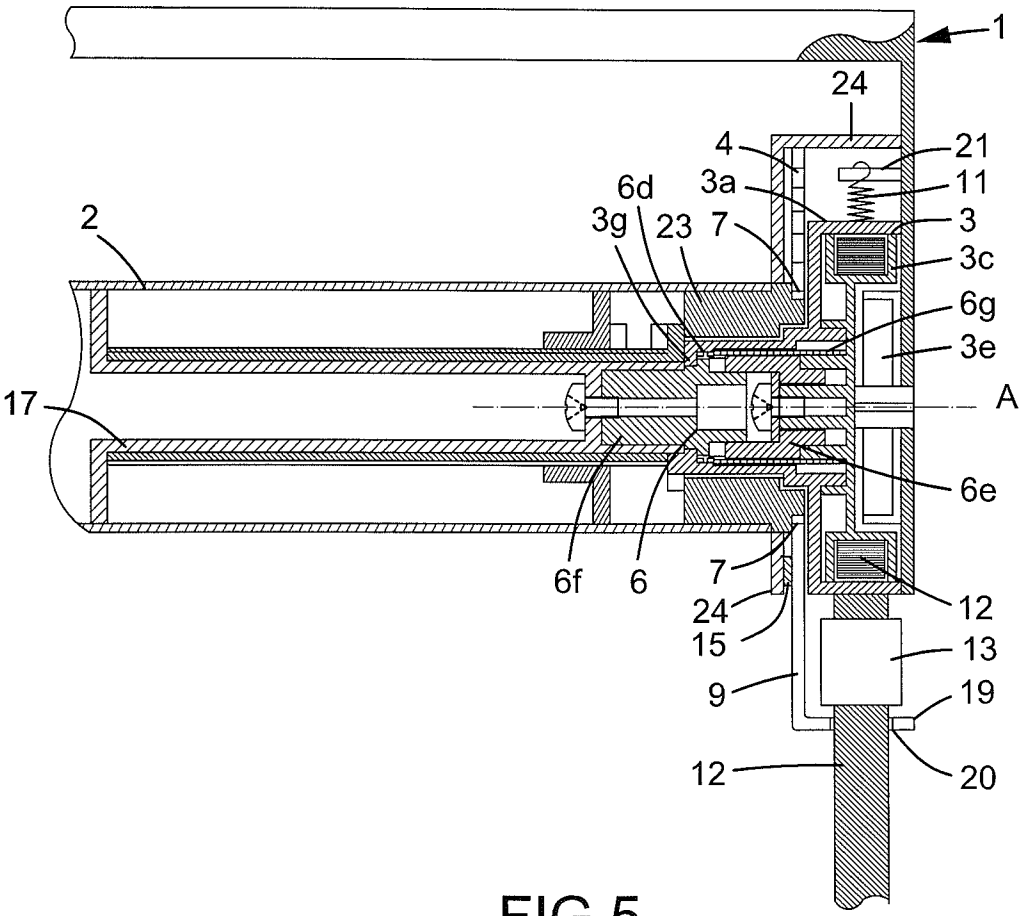
FIG. 5 is a partial, cross-sectional view of the single pull rope driving device of FIG. 1.

The single pull rope driving device of the present invention further includes a gear 7 rotatably mounted to bracket 1 or pull rope rotary disc box 3*a* of rotation driving device 3. In this embodiment, gear 7 is connected to reeling drum 2 and located outside of pull rope rotary disc box 3*a*. Gear 7 includes a plurality of teeth 7*a* on an outer periphery thereof. Each tooth 7*a* of gear 7 is a ratchet tooth and includes an upright edge 71 and an inclined edge 72 located in front of the upright edge 71 in the releasing direction of reeling drum 2 (the counterclockwise direction as viewed from FIG. 1). A protective housing 24 is mounted around gear 7 to protect gear 7 and associated members (FIG. 5).

The single pull rope driving device of the present invention further includes a pulling bar 4 supported beside gear 7 and movably mounted to bracket 1 or pull rope rotary disc box 3*a* of rotation driving device 3. Pulling bar 4 includes a rack 9 movable in a vertical direction. Rack 9 includes upper and lower ends 91 and 92 spaced from each other in the vertical direction. A toothed portion 10 with a plurality of teeth 10*a* is formed on an inner side of upper end 91 of rack 9. Each tooth 10*a* is a ratchet tooth and includes a horizontal edge 101 and an inclined edge 102 located above horizontal edge 101 in the vertical direction. A protrusion 14 extends from an outer side of upper end 91 of rack 9. An arcuate groove 16 is formed in an intermediate portion 93 between upper and lower ends 91 and 92 of rack 9 to accommodate a portion of gear 7. An extension 19 extends transversely from an inner side of lower end 92 of rack 9 and is located below gear 7 in the vertical direction. A notch 8 with an opening 81 is formed in extension 19 (FIG. 4), and pull rope 12 extends through and is releasably engaged in notch 8, allowing smooth, downward pulling of pull rope 12. Furthermore, an actuating member 13 is mounted on pull rope 12 between notch 8 of rack 9 and gear 7 in the vertical direction. When pull rope 12 is pulled downward, actuating member 13 presses against extension 19 of rack 9 to move rack 9 downward in the vertical direction. On the other hand, when pull rope 12 is pulled in the horizontal direction and disengages from notch 8 through opening 81 (see arrow A1 in FIG. 1), reeling drum 2 can freely rotate in the winding direction (see arrow C in FIG. 3) by pulling pull rope 12 downward without actuating rack 9 (see arrow A2 in FIG. 3).

The single pull rope driving device of the present invention further includes a return spring 11 mounted between pulling bar 4 and pull rope rotary disc box 3*a* or bracket 1. In the embodiment, a first tang 111 of return spring 11 is attached to a positioning post 21 provided on bracket 1, and a second tang 112 of return spring 11 is attached to protrusion 14 of rack 9. When pull rope 12 is in a free state (not pulled), return spring 11 biases rack 9 upward in the vertical direction to a disengagement position, so that toothed portion 10 of rack 9 is located away from gear 7, and teeth 10*a* on rack 9 are disengaged from teeth 7*a* of gear 7 (see FIG. 1). Furthermore, a stop 15 is mounted on pull rope rotary disc box 3*a* or bracket 1 and located below protrusion 14 of rack 9 in the vertical direction. When rack 9 is moved downward in the vertical direction, protrusion 14 of rack 9 will comes in contact with stop 15 for limiting a descending distance of rack 9. In the embodiment, stop 15 is a roller rotatable about a pin 18 mounted on bracket 1 and abuts against the outer side of rack 9, so that movement of rack 9 can be guided by stop 15 and gear 7 in the vertical direction.

Figure 8A:
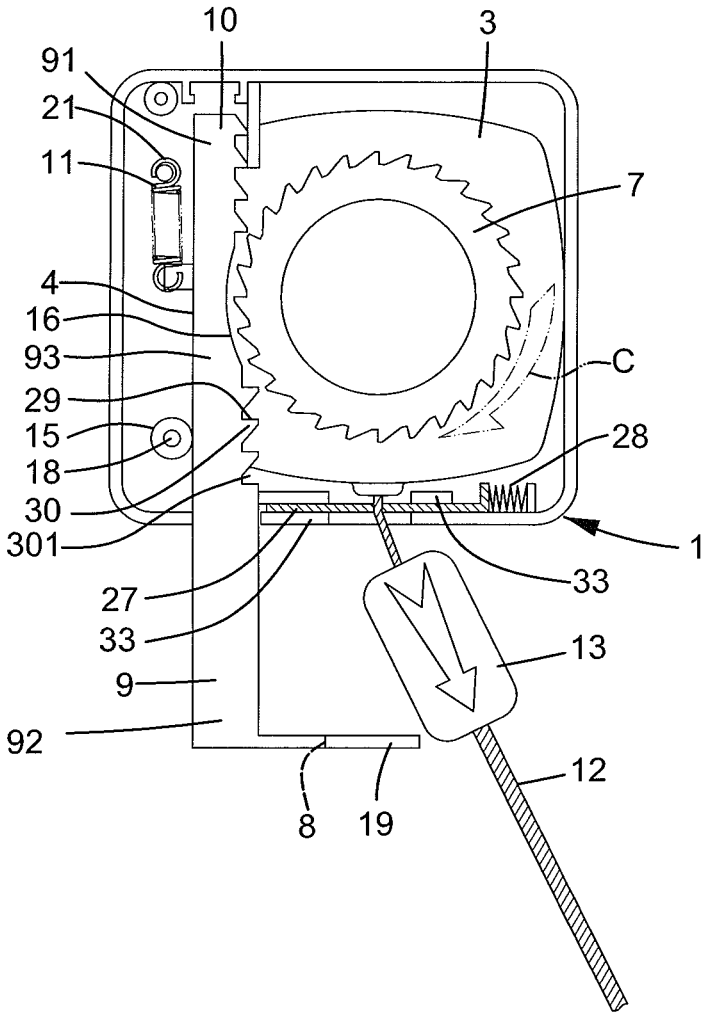
FIG. 8*a* shows a view similar to FIG. 3, illustrating a second embodiment of the single pull rope driving device.
Figure 8B:
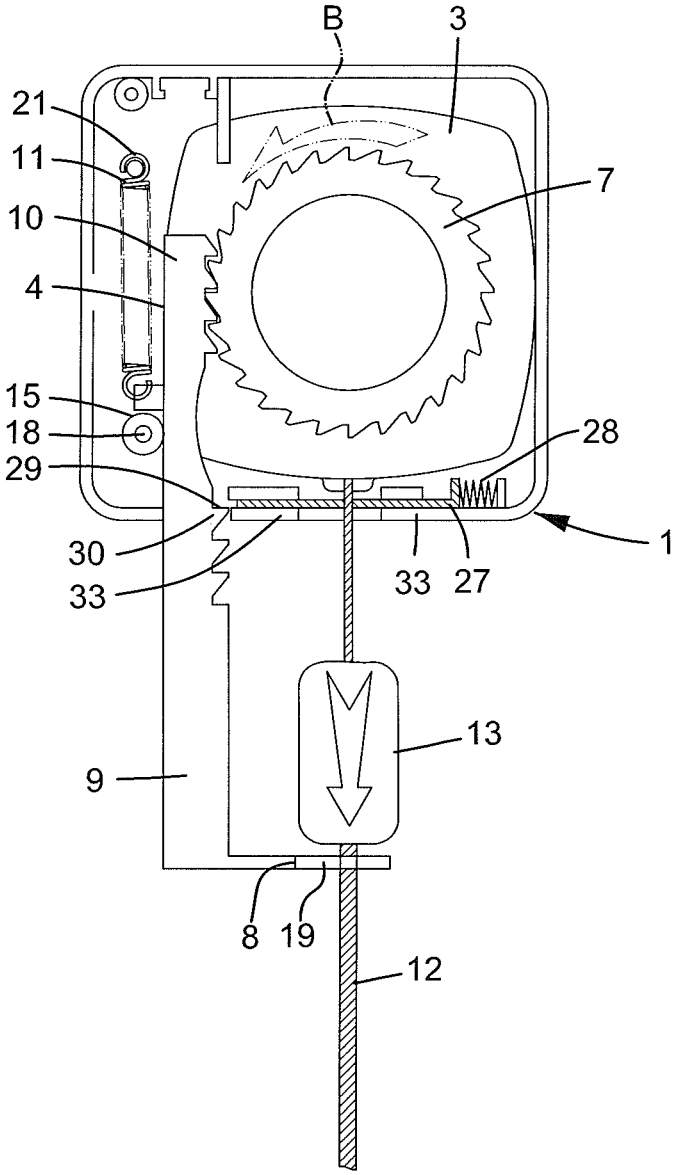
FIG. 8*b* shows a view similar to FIG. 8*a*, with the pulling bar moved downward and engaged with a gear.
Figure 8C:
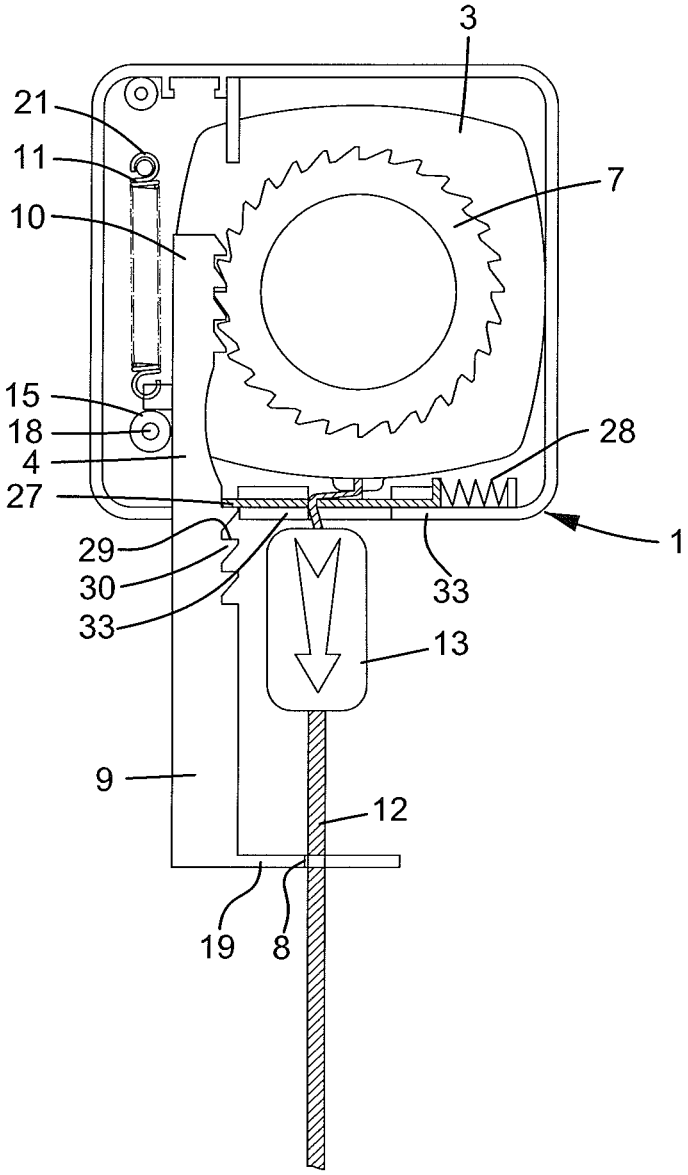
FIG. 8*c* shows a view similar to FIG. 8*b*, with the pull cord released and with a positioning plate engaged on one of stop faces of the rack.

FIGS. 8*a*, 8*b*, and 8*c*, show another embodiment of the single pull rope driving device according to the present invention. In this embodiment, rack 9 further includes a plurality of stop faces 29 formed on an inner side of intermediate portion 93 of rack 9 and located below arcuate groove 16 of rack 9 in the vertical direction. In this embodiment, rack 9 includes a plurality of positioning teeth 30 defining a plurality of grooves 301, with each groove 301 having a horizontal face forming one of stop faces 29. A positioning plate 27 is mounted to bracket 1 or pull rope rotary disc box 3*a* and located between gear 7 and extension 19 of rack 9 in the vertical direction. Pull rope 12 extends through positioning plate 27, such that positioning plate 27 is actuatable by pull rope 12 to move in the horizontal direction. A spring 28 is mounted between a rear end of positioning plate 27 and the bracket 1 or pull rope rotary disc box 3*a* for biasing positioning plate 27 towards rack 9. When rack 9 is moved downward, a front end of positioning plate 27 biased by spring 28 can be releasably engaged with one of stop faces 29 of rack 9. Furthermore, bracket 1 includes a slide track 33 for guiding positioning plate 27.

Figure 2A:
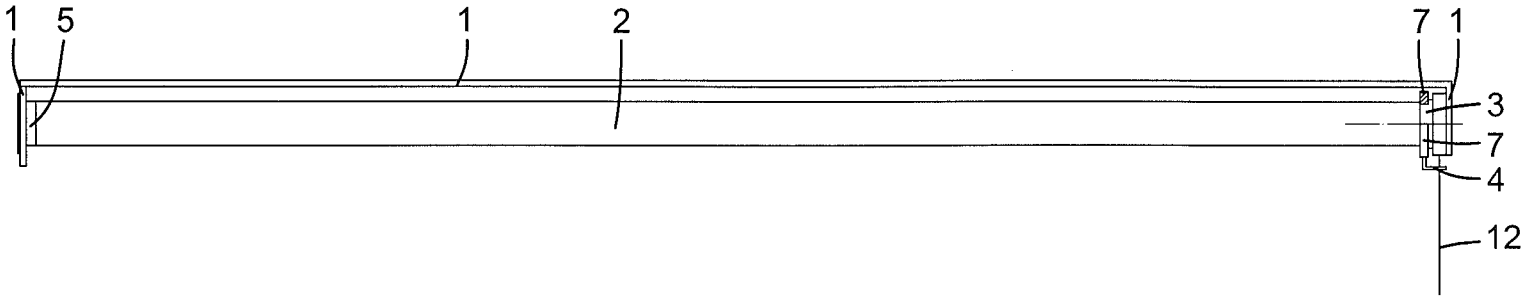
FIG. 2*a* is a schematic elevational view of the single pull rope driving device of FIG. 1.
Figure 2B:
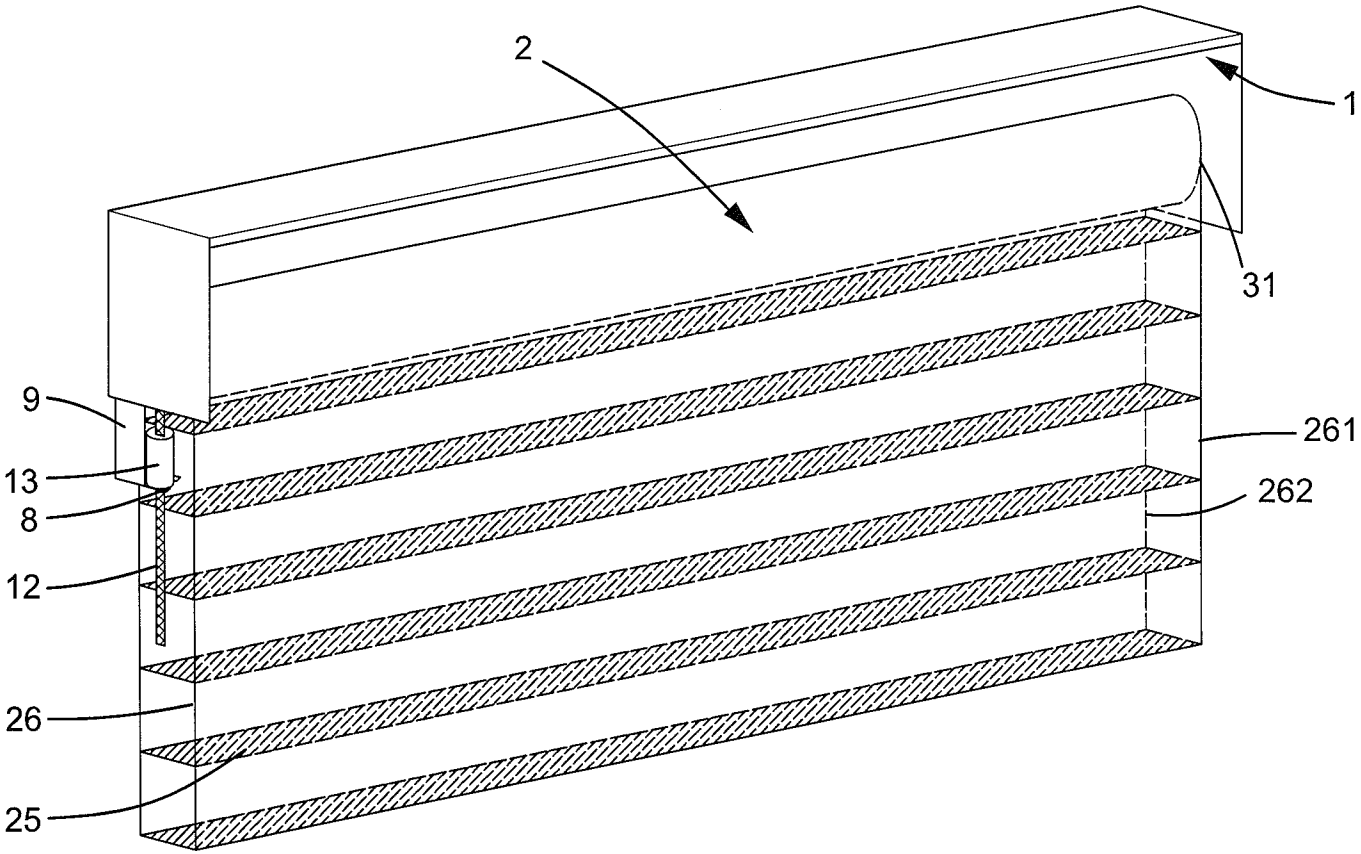
FIG. 2*b* is a perspective view illustrating use of the single pull rope driving device of the present invention on a window shade.
Figure 3:
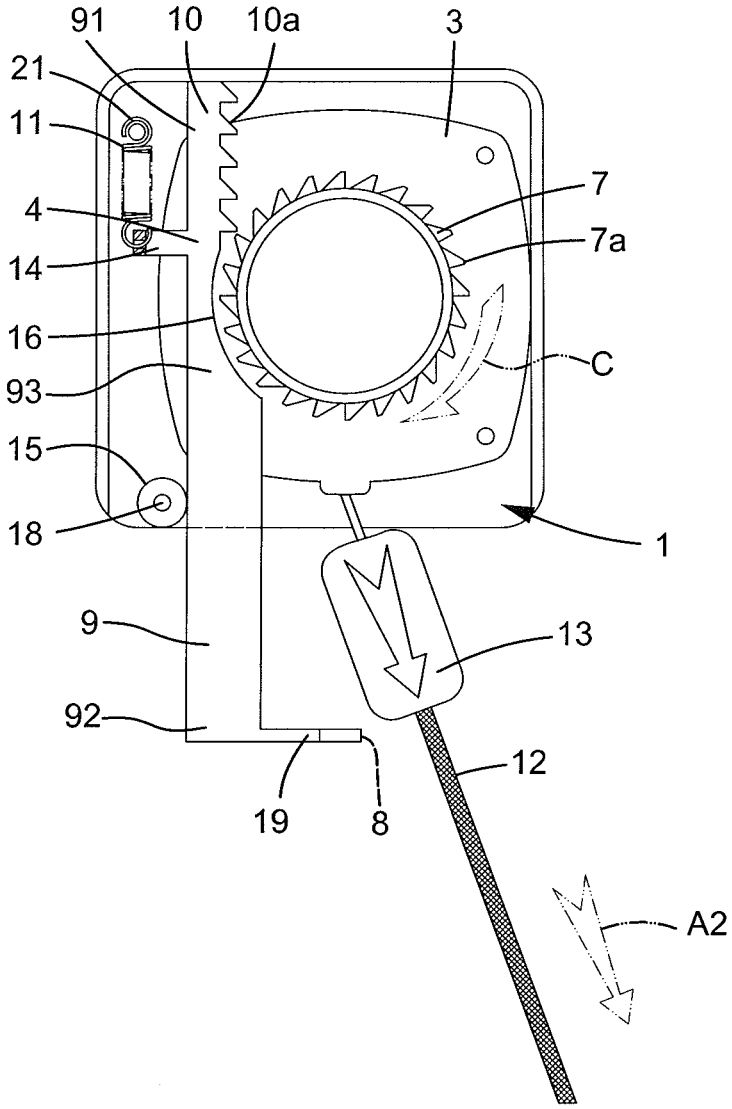
FIG. 3 shows a view similar to FIG. 1, with a pull cord disengaged from a rack of a pulling bar.
Figure 4:
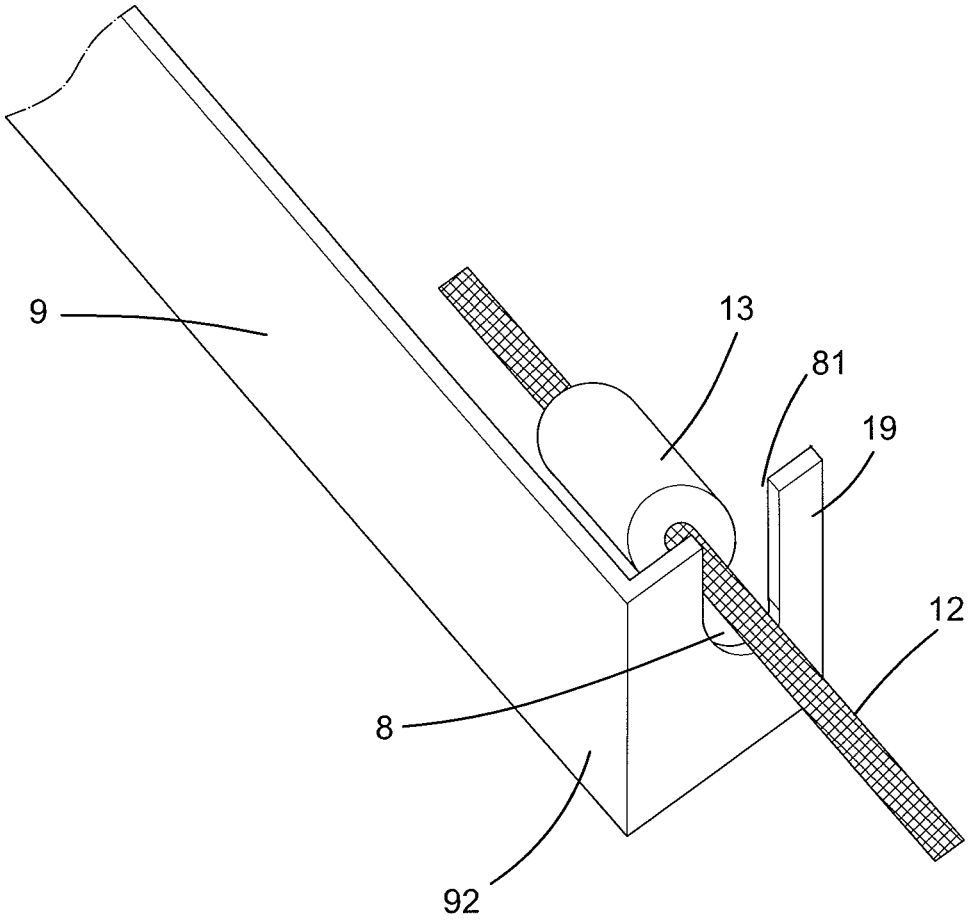
FIG. 4 is a perspective view of the rack and an actuating member attached to the pull cord.
Figure 9:
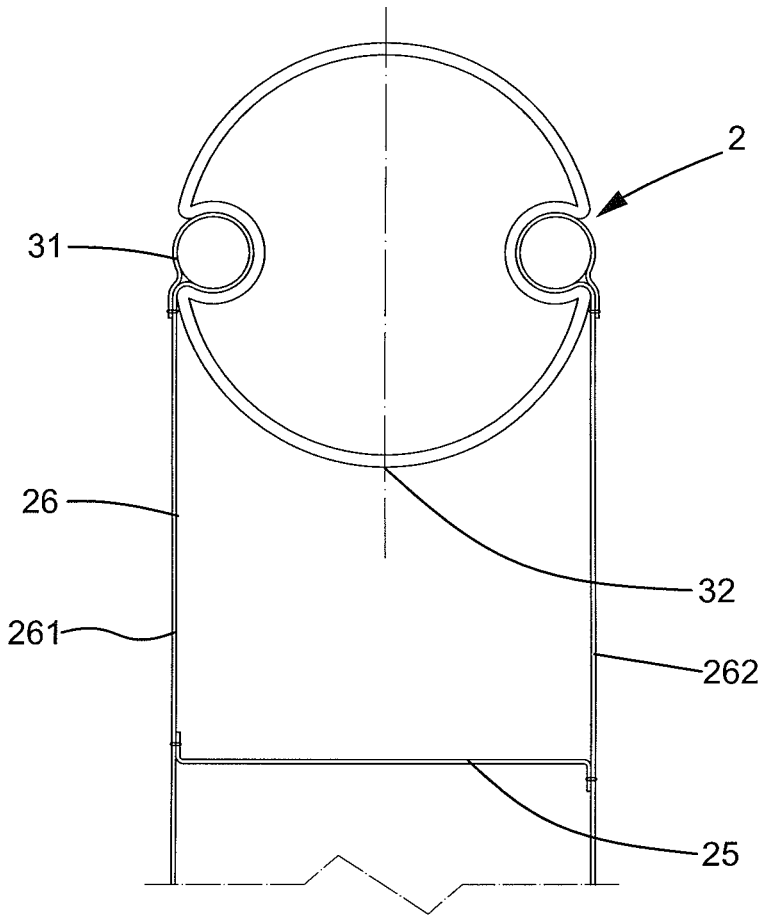
FIG. 9 is a schematic side view of FIG. 2*b*.

As shown in FIGS. 2*b* and 9, the single pull rope driving device of the present invention is applied to a window shade of a type having a light-transmittable curtain cloth 26 with front and rear portions 261 and 262. An end 31 of each of front and rear portions 261 and 262 of curtain cloth 26 is connected to reeling drum 2. A plurality of slats 25 is provided between front and rear portions 261 and 262 of curtain cloth 26 and spaced from one another in a length direction of curtain cloth 26. Each slat 25 is opaque and made of fabric. After curtain cloth 26 is released from reeling drum 2, if slats 25 located between front and rear portions 261 and 262 are substantially perpendicular to or slightly tilted relative to the vertical direction (see FIG. 2*b*), curtain cloth 26 is in a fully or partially opened state (end 31 is in a position higher than a lowest point 32 of reeling drum 2, see FIG. 9). On the other hand, if slats 25 located between front and rear portions 261 and 262 are at a lager acute angle (such as 45°) to the vertical direction, curtain cloth 26 is in a closed state.

Figure 6:
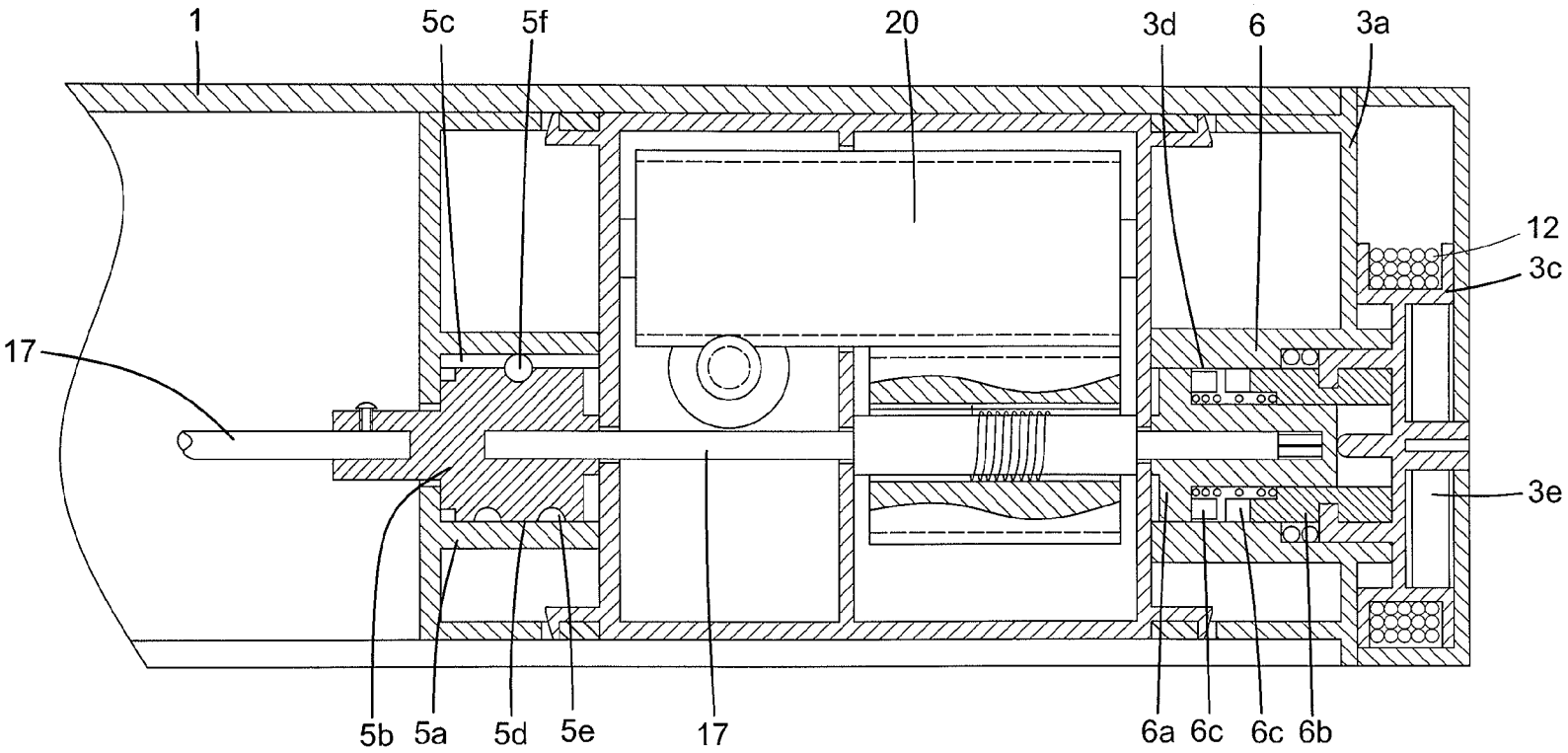
FIG.6 Prior Art
FIG. 6 is a partial, cross-sectional view showing structure of a conventional reverse rotation releasing device.
Figure 7:
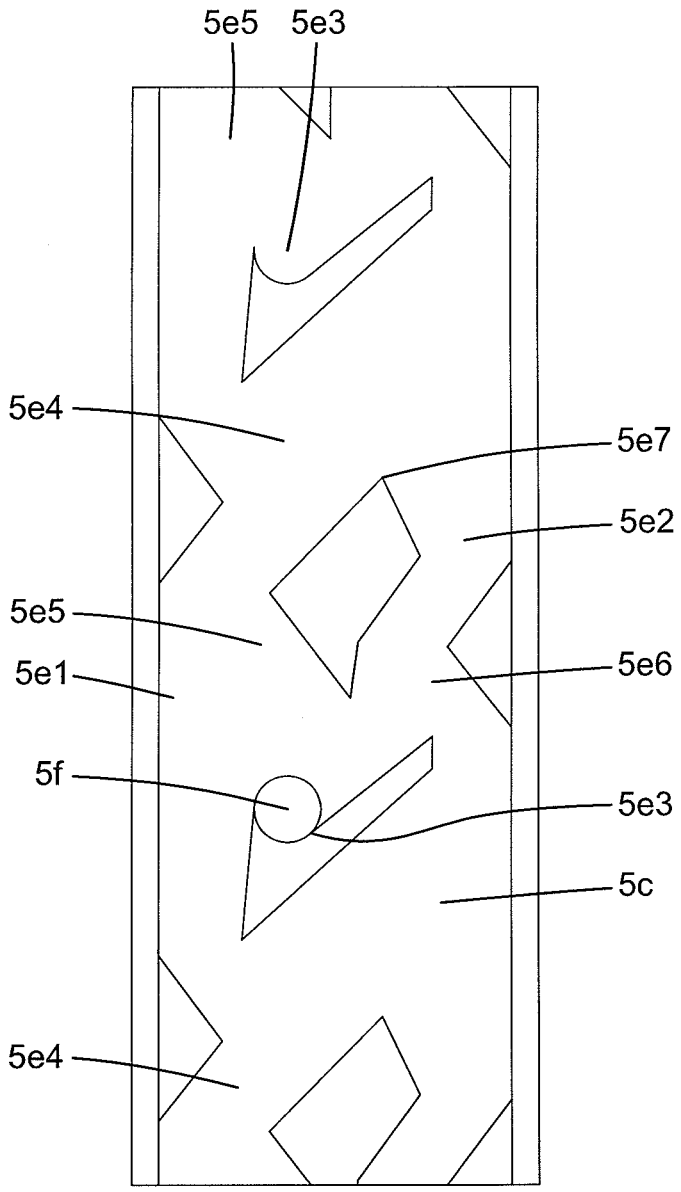
FIG.7 Prior Art
FIG. 7 shows a flattened view of a surface of a sleeve of the reverse rotation releasing device of FIG. 6.

In this embodiment, gear 7 is jointly rotatable with reeling drum 2 through a connecting sleeve 23 and a reverse rotation releasing device 5 provided in reeling drum 2. Connecting sleeve 23 is mounted around an outer periphery of a clutch body 3*g* (FIG. 5). With reference to FIGS. 6 and 7, rotation releasing device 5 includes a sleeve 5*a* mounted to bracket 1 and a sleeve shaft 5*b* mounted in sleeve 5*a* and connected to rotary shaft 6*a* through transmission shaft 17. Transmission shaft 17 extends into and is connected to sleeve shaft 5*b*. An interior side wall of sleeve 5*a* is provided with a guide groove 5*c*. A continuous sliding path 5*e* is formed along a surface 5*d* of sleeve shaft 5*b*. A ball 5*f* is mounted between guide groove 5*c* and sliding path 5*e*. With reference to FIG. 7, sliding path 5*e* is comprised of one or more groups of left and right sliding paths 5*e*1, 5*e*2 and an intermediate V-shaped sliding path 5*e*3.

In a direction of left sliding path 5e1 and intermediate sliding path 5e3 there are guiding mouths 5e4, 5e5 for respective directions to right sliding path 5e2 and left sliding path 5e1. In another direction of right sliding path 5e2 there is a guide mouth 5e6 for direction to intermediate V-shaped sliding path 5e3. An example of reverse rotation releasing device 5 is shown in China Patent Publication Nos. CN 101263969A and CN 1693651A (Application Nos. 200810027859.6 and 200510035324.X). However, other forms of reverse rotation releasing device 5 can be used.

In operation, when pull rope 12 is moved out of notch 8 through opening 81 and obliquely pulled downwards, reeling drum 2 will be rotated in the winding direction through unidirectional clutch device 6 without actuating rack 9, so that curtain cloth 26 is wound onto reeling drum 2, as shown in FIG. 8*a*. On the other hand, when pull rope 12 is moved out of notch 8 through opening 81 and shortly pulled downwards and then released, reeling drum 2 will be rotated through a small angle to initiate the releasing action of the reverse rotation releasing device 5, so that curtain cloth 26 is released from reeling drum 2 under the action of the gravity acting on curtain cloth 26 until curtain cloth 26 is fully released. Due to the structure of the window shade, the released curtain cloth 26 is initially in the closed state (slats 25 located between front and rear portions 261 and 262 are at the lager acute angle to the horizontal direction). Specifically, the window shade is generally provided with a speed reducing device to reduce the falling speed of curtain cloth 26, so that curtain cloth 26 can not be completely unfolded due to the damping effect of the speed reducing device when curtain cloth 26 is fully released in the releasing direction. An example of the speed reducing device is shown in China Patent Application Nos. 200810027859.6 and 200910041287.1. However, other forms of the speed reducing device can be used.

With the provision of gear 7, rack 9, and actuating member 13 of the single pull rope driving device of the present invention, reeling drum 2 can be further rotated in the releasing direction to control the opened extent of curtain cloth 26. Specifically, when curtain cloth 26 is released and in the closed state, if pull rope 12 is pulled back into notch 8 and slightly pulled downward, rack 9 is moved downward in the vertical direction by actuating member 13 pressing against extension 19 of rack 9, as shown in FIG. 8*b*. During downward movement of rack 9, teeth 10*a* of rack 9 are engaged with teeth 7*a* of gear 7, so that gear 7 is driven by rack 9 through an angle, and reeling drum 2 and gear 7 rotate jointly in the releasing direction (see arrow B in FIG. 8*b*) and, thus, opens curtain cloth 26 (slats 25 located between front and rear portions 261 and 262 are substantially perpendicular to the vertical direction, see FIG. 9). When pull rope 12 is released, rack 9 is moved upward to the disengagement position by return spring 11. During upward movement of rack 9, gear 7 does not rotate in the winding direction due to contact between inclined edges 102 of teeth 10*a* of rack 9 and inclined edges 72 of teeth 7*a* of gear 7. As such, reeling drum 2 can be driven in either direction by pulling pull rope 12. On the other hand, when pull rope 12 is pulled in the horizontal direction to disengage from notch 8 and then obliquely pulled downwards, reeling drum 2 can be rotated in the winding direction, allowing curtain cloth 26 to be retracted onto reeling drum 2 (see arrow C in FIG. 8*a*).

It can be appreciated that pull rope 12 must be pulled by a predetermined distance to enable rotation of reeling drum 2 in the winding direction through unidirectional clutch device 6. As such, since the limited descending distance of rack 9 (the spacing between protrusion 14 of rack 9 in the disengagement position in FIGS. 1 and 8*a* and stop 15) is shorter than the predetermined distance necessary for driving reeling drum 2 to rotate in the winding direction, unidirectional clutch device 6 will not be actuated during rotation of gear 7 and reeling drum 2 in the releasing direction when rack 9 is actuated by pulling pull rope 12, so that both gear 7 and reeling drum 2 can be smoothly rotated in the releasing direction. Thus, no conflict occurs between releasing and winding operations of reeling drum 2 through gear 7 and unidirectional clutch device 6 in opposite directions through pulling pull rope 12. Winding and releasing operations of reeling drum 2 in opposite directions can be achieved by using a single pull rope 12.

In a case that curtain cloth 26 is light, the weight of curtain cloth 26 can be balanced by the friction of rotation driving device 3 to retain slats 25 in the horizontal position when curtain cloth 26 is completely opened (FIG. 9). However, reeling drum 2 will be rotated in the winding direction and close slats 25 again in a case that the weight of curtain cloth 26 is greater than the friction of rotation driving device 3. Due to provision of positioning plate 27 and stop faces 29, reeling drum 2 will not rotate in the winding direction under the action of the weight of curtain cloth 26 after curtain cloth 26 is completely released and opened while allowing control of opened extent of curtain cloth 26. Specifically, when pull rope 12 engaged in notch 8 of rack 9 is pulled downward by a distance shorter than or the same as the limited descending distance of rack 9 (see FIG. 8*b*), tensioned pull rope 12 keeps positioning plate 27 in a position disengaged from stop faces 29 of rack 9 and moves rack 9 downward, further rotating reeling drum 2 in the releasing direction to move slats 25 of curtain cloth 26. Then, pull rope 12 is released, and positioning plate 27 freed from control of pull rope 12 moves forward and is engaged on one of stop faces 29 of rack 9 under the action of spring 28 (see FIG. 8*c*), keeping rack 9 away from the disengagement position (FIG. 8*a*). Thus, curtain cloth 26 is reliably retained in the open position (slats 25 are in the substantially horizontal position), because reeling drum 2 positioned by gear 7 under engagement of teeth 10*a* of rack 9 does not rotate in the winding direction.

When it is desired to move slats 25 to the tilted, closed position to close curtain cloth 26, pull rope 12 is pulled tight to disengage positioning plate 27 from stop faces 29 of rack 9. Rack 9 returns to its initial position under the action of return spring 11, so that reeling drum 2 and gear 7 are in the free state again (FIGS. 1 and 8*a*). In this case, slats 25 can be moved to the tilted, closed position by pulling pull rope 12 or under the action of the weight of curtain cloth 26.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

The invention claimed is:

1. A single pull rope driving device for a window curtain comprising:

a bracket (1);

a rotation driving device (3) mounted to the bracket (1) and including a pull rope (12);

a reeling drum (2) rotatably mounted to the bracket (1) or the rotation driving device (3), with the reeling drum (2) adapted to release/wind a curtain cloth (26) by pulling the pull rope (12);

a gear (7) rotatably mounted to the bracket (1) or the rotation driving device (3), with the gear (7) jointly rotatable with the reeling drum (2), with the gear (7) including a plurality of teeth (7*a*);

an actuating member (13) mounted on the pull rope (12) and located below the gear (7) in a vertical direction;

a rack (9) movable in the vertical direction and including upper and lower ends (91) and (92) spaced from each other in the vertical direction, with the upper end (91) of the rack (9) including at least one tooth (10*a*) releasably engaged with the plurality of teeth (7*a*) of the gear (7), with the lower end (92) of the rack (9) located below the gear (7) in the vertical direction and actuatable by the actuating member (13); and a return spring (11) coupled to the rack (9), with the return spring (11) biasing the rack (9) to a disengagement position in which the at least one tooth (10*a*) of the rack (9) is disengaged from the plurality of teeth (7*a*) of the gear (7), with the gear (7) and the reeling drum (2) rotatable in a releasing or winding direction by pulling the pull rope (12) downward without actuating the rack (9), wherein if the actuating member (13) is actuated by pulling the pull rope (12) to move the rack (9) downward in the vertical direction, the at least one tooth (10*a*) of the rack (9) is moved to engage with the plurality of teeth (7*a*) of the gear (7) and drives the gear (7) and the reeling drum (2) to rotate in the releasing direction.

2. The single pull rope driving device according to claim 1, with the rack (9) further including an extension (19) extending transversely from the lower end (92) of the rack (9), with a notch (8) formed in the extension (19) of the rack (9) and having an opening (81), with the pull rope (12) releasably engaged in the notch (8) via the opening (81), wherein when the pull rope (12) is engaged in the notch (8) and pulled downward, the actuating member (13) presses against the extension (19) of the rack (9) to move the rack (9) downward in the vertical direction and to drive the gear (7) to rotate in the releasing direction.

3. The single pull rope driving device according to claim 2, with the rack (9) further including a protrusion (14) extending from an outer side of the upper end (91) of the rack (9), with the rack (9) further including a stop (15) located below the protrusion (14) of the rack (9) in the vertical direction, wherein downward movement of the rack (9) is stopped when the protrusion (14) of the rack (9) comes in contact with the stop (15).

4. The single pull rope driving device according to claim 3, with the actuating member (13) located between the notch (8) of the rack (9) and the gear (7) in the vertical direction, with each of the plurality of teeth (7*a*) of the gear (7) being a ratchet tooth having an upright edge (71) and an inclined edge (72) located in front of the upright edge (71) in the releasing direction of the reeling drum (2), with the at least one tooth (10*a*) being a ratchet tooth and including a horizontal edge (101) and an inclined edge (102) located above the horizontal edge (101) in the vertical direction.

5. The single pull rope driving device according to claim 3, with the return spring (11) including a first tang (111), with the first tang (111) adapted to be attached to the bracket (1), with the return spring (11) further including a second tang (112) attached to the protrusion (14) of the rack (9).

6. The single pull rope driving device according to claim 3, with the stop (15) being a roller rotatably abutting against the outer side of the rack (9), with the roller adapted to be rotatably mounted to the bracket (1).

7. The single pull rope driving device according to claim 3, with an arcuate groove (16) formed in an intermediate portion (93) between the upper and lower ends (91) and (92) of the rack (9), with the groove (16) accommodating a portion of the gear (7).

8. The single pull rope driving device according to claim 3, with the rack (9) further including at least one stop face (29) formed on an inner side of the rack (9) and extending in a horizontal direction perpendicular to the vertical direction, with a positioning plate (27) mounted between the gear (7) and the extension (19) of the rack (9) in the vertical direction, with the positioning plate (27) being actuatable by the pull rope (12) to move in the horizontal direction, with the positioning plate (27) releasably engaged with the at least one stop face (29) of the rack (9) when the rack (9) is moved downward by pulling the pull rope (12).

9. The single pull rope driving device according to claim 8, further comprising: a spring (28), with an arcuate groove (16) formed in an intermediate portion (93) between the upper and lower ends (91) and (92) of the rack (9), with the groove (16) accommodating a portion of the gear (7), with the at least one stop face (29) including a plurality of stop faces (29) spaced from each other in the vertical direction and located below the groove (16) of the rack (9), with the spring (28) biasing the positioning plate (27) towards the rack (9).

* * * * *